US011136684B2

(12) United States Patent
Fiorucci et al.

(10) Patent No.: US 11,136,684 B2
(45) Date of Patent: Oct. 5, 2021

(54) ELECTRODE STRUCTURE PROVIDED WITH RESISTORS

(71) Applicant: INDUSTRIE DE NORA S.P.A., Milan (IT)

(72) Inventors: Alessandro Fiorucci, Milan (IT); Michele Perego, Milan (IT); Paolo Perrone, Milan (IT); Corrado Mojana, Milan (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 40 days.

(21) Appl. No.: 16/081,707

(22) PCT Filed: Mar. 8, 2017

(86) PCT No.: PCT/EP2017/055476
§ 371 (c)(1),
(2) Date: Aug. 31, 2018

(87) PCT Pub. No.: WO2017/153489
PCT Pub. Date: Sep. 14, 2017

(65) Prior Publication Data

US 2019/0062937 A1 Feb. 28, 2019

(30) Foreign Application Priority Data

Mar. 9, 2016 (IT) ..... 102016000024365
Aug. 5, 2016 (IT) ..... 102016000083106

(51) Int. Cl.
*C25B 15/02* (2021.01)
*C25C 7/06* (2006.01)
(Continued)

(52) U.S. Cl.
CPC ..... *C25C 7/06* (2013.01); *C25B 1/26* (2013.01); *C25B 11/02* (2013.01); *C25C 1/00* (2013.01); *C25C 1/12* (2013.01); *C25C 7/02* (2013.01)

(58) Field of Classification Search
CPC .. C25B 15/02; C25B 9/00; C25B 9/06; C25B 9/04; C25C 7/06; C25C 7/02; C25C 3/16; C25C 7/00
See application file for complete search history.

(56) References Cited

U.S. PATENT DOCUMENTS 5,100,525 A 3/1992 Pohto et al.
2016/0010233 A1 1/2016 Grant
2017/0009359 A1* 1/2017 Prado Pueo ..... C25C 7/02

FOREIGN PATENT DOCUMENTS

WO 2015/079072 A2 6/2016

OTHER PUBLICATIONS

International Search Report and Written Opinion for International Application No. PCT/EP2017/055476 (dated May 17, 2017) (12 Pages).

(Continued)

*Primary Examiner* — Zulmariam Mendez
(74) *Attorney, Agent, or Firm* — Lucas & Mercanti, LLP

(57) ABSTRACT

The invention relates to an electrode which can be employed in the cells of plants for the electrolytic extraction of copper and other non-ferrous metals from ionic solutions. The electrode consists of an apparatus comprising at least one anodic panel for the evolution of oxygen or chlorine connected through a plurality of resistors in parallel to at least one distribution structure for electrical current. The panel may optionally exhibit areas of electrical discontinuity. The invention also relates to an electrolyser using the electrode described above.

20 Claims, 8 Drawing Sheets

(51) Int. Cl.

| | |
|---|---|
| ***C25C 1/12*** | (2006.01) |
| ***C25C 7/02*** | (2006.01) |
| ***C25C 1/00*** | (2006.01) |
| ***C25B 1/26*** | (2006.01) |
| ***C25B 11/02*** | (2021.01) |

(56) References Cited

OTHER PUBLICATIONS

International Preliminary Report on Patentability for International Application No. PCT/EP2017/055476 (dated Jun. 29, 2018) (22 Pages).

* cited by examiner

ELECTRODE STRUCTURE PROVIDED WITH RESISTORS

This application is a U.S. national stage of PCT/EP2017/055476 filed on Mar. 8, 2017 which claims the benefit of priority from Italian Patent Application Nos. 102016000024365 filed Mar. 9, 2016 and 102016000083106 filed Aug. 5, 2016 the contents of each of which are incorporated herein by reference.

FIELD OF THE INVENTION

The invention relates to an electrode which can be usefully employed in electrolysers for electrorefining and electrowinning plants.

BACKGROUND OF THE INVENTION

Metal electrodeposition plants, such as for example plants intended for the electrolytic extraction of non-ferrous metals, generally use one or more electrolysers, each comprising a plurality of elemental cells. The elemental cells comprise an anode and a cathode, generally located in alternate and mutually parallel positions in the electrolytic bath. The anodes and cathodes are supplied with electrical power through a current distribution system comprising at least one anodic bus-bar and at least one cathodic bus-bar placed in proximity of the anodes and cathodes respectively, and electrically connected thereto.

Each electrode is electrically powered and typically supported in the electrolytic bath in a vertical position through conducting supporting elements. These elements comprise a hanger bar attached or connected to one or more current-carrying bus-bars and one or more electrical current distribution structures which connect the electrode to its own hanger bar.

In processes for the electrowinning of non-ferrous metals such as copper, zinc or nickel the metal deposition at the cathodes can take place in a non-uniform manner and give rise to dendritic formations which grow towards the opposite anode at increasing speed with the passage of electrical current. As well as having an adverse effect on the quality and quantity of the harvested metal, the dendrites may cause electrical short circuits upon contact with the opposing anode, often damaging to the electrode, threatening the plant's safety, and having a very adverse effect on current distribution throughout the electrolyser. With anodes of modern construction made from mesh, louver structures, perforated sheets, sheets or expanded meshes and sheets of titanium or other valve metals, which have the advantage of operating with reduced energy consumption in comparison with conventional lead anodes, the short circuits caused by dendritic formations may bring about extensive and irreversible damage to the electrode and require timely action by the plant's personnel. However, such need of human interventions is undesirable: most plants for the electrolytic extraction of non-ferrous metals are unhealthy and potentially hazardous environments; the periods during which plant personnel is exposed to the acid mists from the electrolysers should be kept as brief as possible.

However, the solutions which tackle this issue with automatic monitoring systems for controlling the current flowing through the electrolysers are currently complex and expensive to make and/or have serious efficiency and reliability problems. The acid environment of the electrolyte bath, the high current densities, the periodic removal of cathodes from their seats and the high operating temperatures of the plant constitute undesirable risk factors for the electronic components which are present in the control and monitoring systems known in the art, even when these are provided with suitable protective coatings or embedded in resins.

It is therefore desirable to present a system which allows slowing down the growth of dendritic formations in the above electrodeposition plants and in any event to reduce possible damage caused by any possible direct electrical connection between opposite electrodes, whether the connection is caused by dendrites or misalignment of the electrodes. It is also desirable that such system should employ components of proven strength, robustness and reliability under the operating conditions of an electrowinning plant, without however appreciably reducing the operating efficiency of the same.

SUMMARY OF THE INVENTION

Various aspects of this invention are described in the appended claims. In one aspect the invention relates to an anodic apparatus for the electrorefining or electrowinning of non-ferrous metals. The anodic apparatus comprises at least one anodic panel and at least one electrical current distribution structure electrically connected together by means of a plurality of resistors placed in parallel.

By resistors, here is meant any resistive element having an electrical resistance of $5 \cdot 10^{-5}\Omega$ or more. The resistors may have electrical resistance values which are the same or different.

Hereinafter, the electrical resistance values refer to the values measured at 40° C. With the term anodic panel is meant an element of any shape and size suitable for being used as an anode and which presents at least one surface capable of evolving oxygen or chlorine. This surface may be flat or corrugated, solid, porous, cut, etched or perforated. The anodic panel may be a composite structure, and may also comprise several elements physically separate from each other (subpanels) and each connected with at least one resistor to at least one common electrical current distribution structure. Under nominal operating conditions the subpanels of a given anodic panel will therefore essentially be at the same anodic potential and will be facing a same cathode.

The electrical current distribution structures may comprise one or more conducting bars or plates, such as, but not limited to, copper bars provided with a titanium coating. The electrical current distribution structures may also be sheets or panels of lead or alloys thereof, for example used lead anodes (or used anodes made of lead alloys).

The current distribution structures electrically connect one or more anodic panels to the anode hanger bar. The latter is typically in turn connected to at least one anodic bus-bar that supplies electrical power to the electrode.

The inventors have observed that the apparatus according to the invention can slow the growth of dendritic formations for more than 24 hours, and in case of short circuit between electrodes, reduces the damage to the anodic panel by limiting the maximum current passing through it, thus avoiding further efficiency losses. The electrical configuration according to this invention, characterised by the connection of resistors in parallel, does not have a significant adverse effect on the operating conditions of the plant (in terms, for example, of the dissipation of electrical power) when the cell is operating at nominal values.

In fact, the plurality of resistors connected in parallel is associated with an equivalent electrical resistance which is less than that of the individual resistors, and decreases as their number increases. Without being bound to a specific theory, the inventors observed that when a direct electrical contact is established between the anodic apparatus and the cathode, for example as a result of a dendritic formation or misalignment of the electrodes, the electrical current appears to flow through a specific subset of resistors on account of the electrical resistance of the anodic panel or its further specific geometric/electrical characteristics (such as for example zones of electrical discontinuity capable of producing preferential paths for the current). This subset of resistors is associated with electrical resistance that is higher than that of the equivalent circuit when the apparatus is operating under nominal conditions. This helps in reducing the current discharged through the anodic panel in comparison with what it would be were the latter to be in direct electrical contact with the current distribution structure (or structures).

The choice, number and resistance value of the resistors depends on various factors, such as for example the physical and chemical characteristics of the anodic panel and the current density at which the electrolytic extraction plant is operating.

The resistors may advantageously be designed in such a way that, on the one hand, the equivalent circuit has an acceptable ohmic drop for the plant operations, and, on the other hand, the individual resistors ensure sufficient electrical resistance to limit extensive damage to the anode in the event of contact with dendritic formations (i.e. create a surface damage of less than 2.5 cm×2.5 cm in size. Above this value, the quality of metal deposition is adversely affected). To this effect, when designing the resistance value of the resistors, the skilled person will bear in mind the current density at which the plant is operating and calculate the value of the resistor as a function of the maximum current that can discharge through the anodic panel, given the operating parameters of the cell and the electrode material, without creating extensive damage to its active surface.

The use of ohmic resistors or linear resistors, at least in the temperature range between 20 and 65° C., preferably between 20 and 100° C., may make their design easier and may further ensure their reliability, because of the many uncontrollable factors which contribute to temperature variations in the anodic apparatuses during their operation. These resistors are therefore preferred to non-ohmic or non-linear resistors and thermistors or other known devices such as resettable fuses whose resistance value greatly depends on temperature and/or electrical current strength in a very non-linear manner and which comprise components (such as plastics, small wires) which are potentially hazardous at the operating conditions of electrowinning plants. In order to minimise the increase in cell voltage in comparison with conventional operation using panels directly connected to the current distribution structure, while ensuring the protective role of the resistors, it may be advantageous to select a plurality of resistors arranged in parallel so that they have an equivalent electrical resistance of between $10^{-5}$ and $10^{-3}$ Ohm.

In one embodiment of the apparatus according to the invention the total number of resistors for each anodic panel is between 15 and 600, preferably 20 and 300. The resistance value of the individual resistors being equal, a number of resistors below a particular threshold will result in an increase in the resistance of the equivalent circuit with a consequent fall in performance in energy terms. On the other hand, an excessively high number may make assembly of the anodic apparatus a lengthy and laborious process. In one embodiment the anodic panel described above is subdivided into 2 or 3 subpanels, each subpanel being connected to a current distribution structure through a number of between 15 and 200 resistors, preferably between 20 and 100. According to further embodiments of the invention, it may be advantageous to select resistors from sheets, strips, meshes, cables, fabrics and pads. The resistors may for example be pressed strips, expanded or perforated meshes or sheets of valve metal. Resistors of this type may have the advantage of not suffering corrosion or excessive overheating in the event of a short circuit between the opposing anode and cathode apparatus. By excessive overheating it is meant a rise in the temperature of the resistor of more than 50° C. compared to nominal operating conditions. In addition, contrary to the solutions described in the art which employ conventional electronic components, comprising plastic, ceramic and/or thin wire elements in the anodic apparatus, the apparatus according to the present embodiment foregoes such critical materials and may represent an advantageous solution in terms of safety and service life of the anodic components.

In one embodiment each resistor of the plurality of resistors set in parallel has an electrical resistance of between $1\times10^{-4}$ and 1Ω.

According to a further embodiment each resistor in the plurality of resistors located in parallel has an electrical resistance of between 5 and 100 mΩ. In particular, each electrical resistance may be of between 10 and 50 mΩ.

According to a further embodiment of the invention, the anodic panels comprise a substrate of valve metal or their alloys and at least one catalytic coating. The panels may possibly be provided with other coatings for protection of the substrate or of the catalytic coating itself.

Non-exclusive examples of valve metals are: tungsten, tantalum, titanium, zirconium and niobium.

This latter embodiment may have less environmental impact than conventional lead anodes and above all may offer the advantage of encouraging the anodic reaction because of a lower over-potential for oxygen or chlorine evolution.

According to a further embodiment of the invention, the electrical current distribution structures may comprise at least one sheet or panel made of lead, such as for example an exhausted lead anode. In this way it is possible to retrofit electrolytic cells that used to employ lead anodes, using the exhausted anodes as current distribution structures with a valve metal anodic panel attached thereto. In this case, the existing anodic material remains inside the electrolyser, thereby avoiding disposal issues of the lead structures, while the plant may take advantage of the improved performances in terms of energy cost and/or quantity of product that valve metal can offer.

According to a further embodiment, the apparatus according to the invention is provided with at least one anodic panel selected from expanded meshes, sheets, perforated sheets and louver structures. By louver structures are meant panels provided with a plurality of mutually parallel, typically horizontal, cuts or slots. These structures may have a corrugated profile, for example with a curved section between one slot and another, or like a venetian blind, or characterised by a plurality of parallel strips inclined with respect to the vertical.

The inventors have observed that an anodic panel made of titanium having a louver, perforated sheet or expanded mesh structure optionally provided with cuts may be advantageous when used in the anodic apparatus according to the invention. Its geometrical characteristics in the event of a short circuit with the opposing cathode appear to intrinsically favour the passage of electrical current through a reduced subset of resistors in comparison with the use of a solid sheet.

A single anodic panel in the apparatus according to the invention may be electrically connected to one or more current distribution structures through a plurality of resistors arranged in parallel. Similarly, an individual current distribution structure may be connected to one or more anodic panels through a plurality of parallel resistors.

According to one embodiment of the invention at least one anodic panel comprises a multiplicity of subpanels separated from each other and each subpanel is connected to at least one common electrical current distribution structure through at least one resistor, preferably though a plurality thereof. The set of individual resistors connected to the individual subpanels in fact may be considered as a set of resistors in parallel for the purposes of the electrical circuit describing the elemental electrolytic cell with the anodic apparatus described herein.

The inventors have observed that in order to facilitate the assembly of the anodic apparatus it may be advantageous to limit the subpanels of each anodic panel to a number equal to, or lower than, the number of structures distributing electric current. Each subpanel may advantageously be connected to the corresponding distribution structure through a number of between 10 and 200 resistors, preferably between 15 and 150, even more preferably between 20 and 100.

According to a further embodiment the apparatus according to the invention has at least one anodic panel provided with at least one zone of partial or total electrical discontinuity.

By "zone of electrical discontinuity" is meant an electrically insulating region measuring at least 1 cm along at least one dimension. The discontinuity zone may be located within the anodic panel and optionally include its edges (in this case it is defined as being partial); it may also extend along a whole dimension of the panel, thus subdividing it into several subpanels (in the latter case the discontinuity zone is defined as being total).

The presence of one or more zones of electrical discontinuity may establish preferential electrical paths across the surface of the anodic panel in the event of contact with a dendritic formation, thus favouring the current to discharge through a limited number of resistors.

According to one embodiment of the invention the number of zones of electrical discontinuity for each anodic panel is more than 10, preferably more than 50, even more preferably more than 65.

In the apparatus according to the invention each resistor may be connected to the anodic panel through an electrical connection region of which at least one portion is located on the panel or on its edge. This electrical connection region may also be partly discontinuous, extending over one or more surfaces of the anodic panel and/or through its thickness. It may also be a segment or a point or a discontinuous conglomeration thereof.

In some cases, this region may correspond to the weld between the resistor and the anodic panel. In some cases, this region may be the portion of any conducting element directly connecting the anodic panel to the resistor located on the panel itself. When said conducting element is common to several resistors of the plurality of resistors set in parallel, the electrical connection region relating to the individual resistor is identified by the portion of the conductive element located on the panel corresponding to the shortest electrical path between the individual resistor and the panel.

In some cases, the resistors and the anodic panel may be made out from a single element, such as for example an expanded mesh or sheet or a perforated plate. Said single element is suitably folded and cut in such a way as to have, on one side, an anodic surface on which the electrochemical reaction with the opposing cathode takes place, and, on the other side, a plurality of resistive strips folded behind the anodic surface and connected in parallel to the electrical current distribution structure. In this case by connection region is meant the geometrical area or segment corresponding to the points where the resistive strip morphs into the gas evolving anode surface facing the cathode, and is typically located on the bent edge of said anode surface.

Hereinafter by electrical connection region is meant the geometrical region or segment corresponding to the points where the panel is attached to the resistors, directly or through an electrical connection, or as an alternative is bent, where the bent part connects the surface of the anodic panel opposite the cathode to the plurality of resistors connected to the current distribution structure.

According to a further embodiment of the invention at least one zone of electrical discontinuity is placed between two neighbouring electrical connection regions.

According to a further embodiment of the invention, the anodic apparatus is provided with at least 7 pairs of neighbouring electrical connection regions, preferably at least 20, even more preferably at least 50, and at least one zone of electrical discontinuity is located between each of said pairs of neighbouring electrical connection regions. By neighbouring electrical connection regions are meant two connection regions between which there is no further connection region.

According to a further embodiment of the invention at least one anodic panel is provided with at least 10 zones of electrical discontinuity and at least 10 connection regions, each zone of electrical discontinuity being located at a distance of less than 20 cm from at least one connection region.

According to a further embodiment of the invention at least one anodic panel is provided with at least 20 zones of electrical discontinuity and at least 20 connection regions, each zone of electrical discontinuity being located at a distance of less than 15 cm from at least one connection region.

According to a further embodiment of the invention at least one anodic panel is provided with at least 20 zones of electrical discontinuity and at least 20 connection regions, each zone of electrical discontinuity being located at a distance of less than 10 cm from at least one connection region According to a further embodiment of the invention at least one anodic panel is provided with at least 25 zones of electrical discontinuity and at least 25 connection regions, each zone of electrical discontinuity being located at a distance of less than 10 cm from at least one connection region.

According to a further embodiment of the invention there is at least one zone of electrical discontinuity along at least one predefined direction in the plane of the anodic panel located between each pair of consecutive electrical connection regions along said direction.

This embodiment may offer the advantage of encouraging the current to pass through a small number of resistors in the event of a short circuit in the elemental cell caused by contact with the dendrite, thus limiting the current discharged through the panel and therefore reducing the damage caused to it.

According to another embodiment of the invention there is at least one electrical discontinuity zone for each pair of neighbouring electrical connection regions. For example, where two neighbouring electrical connection regions are positioned at heights h1 and h2 respectively, where h1<h2, at least one zone of electrical discontinuity is located at a height h3, where h1 is less than or equal to h3 and h3 is less than or equal to h2. This configuration may encourage the current to flow through essentially only one resistor in the event of a short circuit caused by direct contact with the dendrite.

The positions of the zones of discontinuity and of the connection regions are identified by the respective positions of their geometric centres (barycentres).

According to a further embodiment of the invention, at least one anodic panel is provided with a number N1 of electrical connection regions connecting the anodic panel to a plurality of resistors in parallel and a number N2 of zones of electrical discontinuity, wherein N1 and N2 satisfy the following criteria: N2 is an integer greater than half N1 and $5 \leq N1 \leq 100$. These connection regions are located along a first vertical strip; the zones of electrical discontinuity are arranged along at least a second vertical strip, optionally overlapping the first either wholly or in part.

A given vertical strip is an imaginary geometrical surface, its height coincides with the height of the anodic panel and its width is such as to contain the horizontal projections of all connection regions or, alternatively, of all the zones of discontinuity, whose horizontal projections overlap in at least one point.

The anodic panel may also be provided with a number N3 of further electrical connection regions located along a third vertical strip which does not coincide with the first, with $5 \leq N3 \leq 100$. The panel may also have a number N4 of further zones of electrical discontinuity, where N4 is an integer larger than half N3, and these further zones of electrical discontinuity are located along a fourth vertical strip, optionally overlapping the third either wholly or in part.

According to a further embodiment, N1 (and/or N3, if present) may be between 10 and 100, 20 and 100, or 20 and 80.

According to further embodiments of the invention the anodic panel may have a plurality of further electrical connection regions located along one or more further separate vertical strips and may optionally have a plurality of further zones of electrical discontinuity located along one or more further vertical strips.

According to another embodiment, at least one zone of electrical discontinuity is a cut, hole or insert of electrically insulating material. By hole is meant a through opening of any nature. By cut is meant an incision through the entire thickness of the panel which may be made with or without removal of material.

In the event of contact with the dendrite the inventors have observed that if the zones of electrical discontinuity have at least one dimension greater than or equal to 5 cm, for example in the case of cuts suitably arranged on the surface of the panel in accordance with the various embodiments described above, the electrical current flowing through the panel can be partially guided along a small number of resistors. In this way the maximum current passing through the panel can be effectively kept below a threshold value which limits the possible damages to the anodic apparatus and preserves the plant's safety.

According to a further embodiment the anodic apparatus according to the invention comprises at least two anodic panels, preferably of titanium, provided with catalytic coating, facing two opposite cathodes. The two panels, which are separate from each other, are selected from louver structures, expanded meshes or sheets. The apparatus also comprises at least two electrical current distribution structures, each connected to at least one panel through a plurality of resistors arranged in parallel with respect to each other. Each panel comprises 5-100 connection regions located along a first vertical strip and each connection region alternates with a horizontal cut of 5 cm in length or more. Each cut has at least one point located at a distance of 0-10 cm from said first vertical strip. The alternation of cuts to the connection regions does not necessarily imply that these are located between two neighbouring areas, but that along a vertical direction the vertical position of each cut is located between the vertical projection of two neighbouring connecting areas.

Alternatively, the cuts may be inclined at an angle of between 20°-60° with respect to the vertical. The cuts may be made with or without the removal of material; in the former case they may be through holes across the thickness of the panel.

According to another aspect, the invention relates to an electrolyser for electrowinning of non-ferrous metals comprising at least one of the anodic apparatuses described above.

BRIEF DESCRIPTION OF THE FIGURES

A number of embodiments of the invention are described by way of example below with reference to the appended drawings, the purpose of which is solely to illustrate the mutual arrangement of the various elements relating to said embodiments of the invention; in particular, the drawings are not to be understood to be scale drawings.

DETAILED DESCRIPTION OF THE FIGURES

Figure 1:
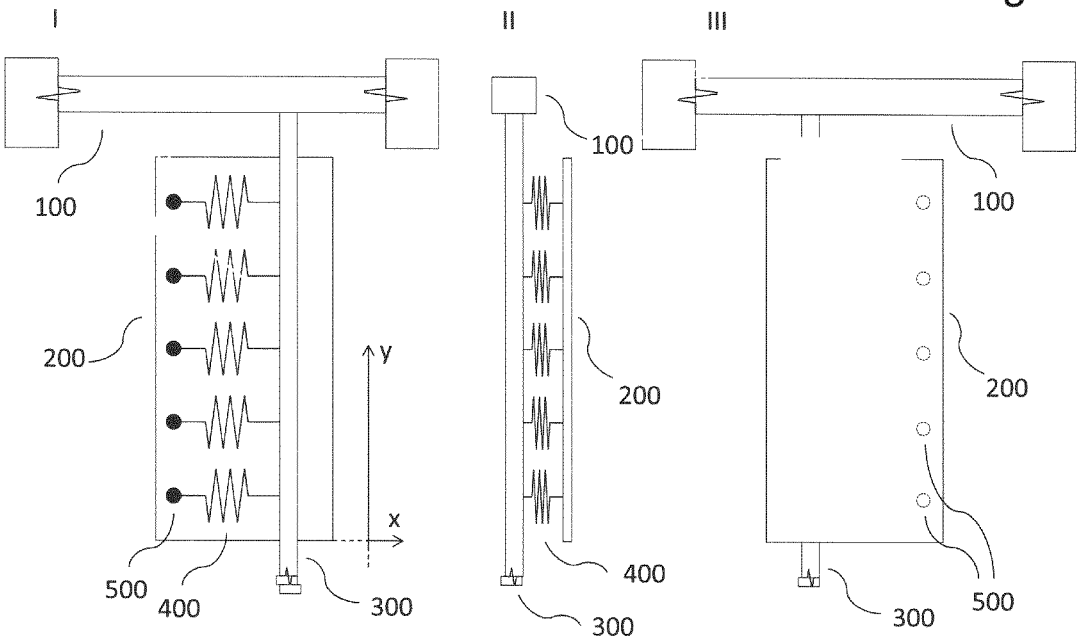
FIGS. 1-13 schematically illustrate a number of embodiments of the anodic apparatus according to the invention.

FIG. 1 shows a rear (I), lateral (II) and frontal (III) schematic projection of the anodic apparatus according to the invention. The figure shows an anodic hanger bar (100) connected to a structure (300) for the distribution of electrical current. The latter is connected to an anodic panel (200) through a plurality of resistors (400), connected to the panel through electrical connection regions (500). The front surface of the anodic panel (view III) is the one where the reaction for the release of oxygen or chlorine occurs. The vertical direction is indicated by the arrow (y); which typically coincides with the vertical direction of a conventional electrowinning cell. The base of the anodic panel (200) is positioned at the height indicated by the x axis, which identifies the horizontal reference.

Figure 2:
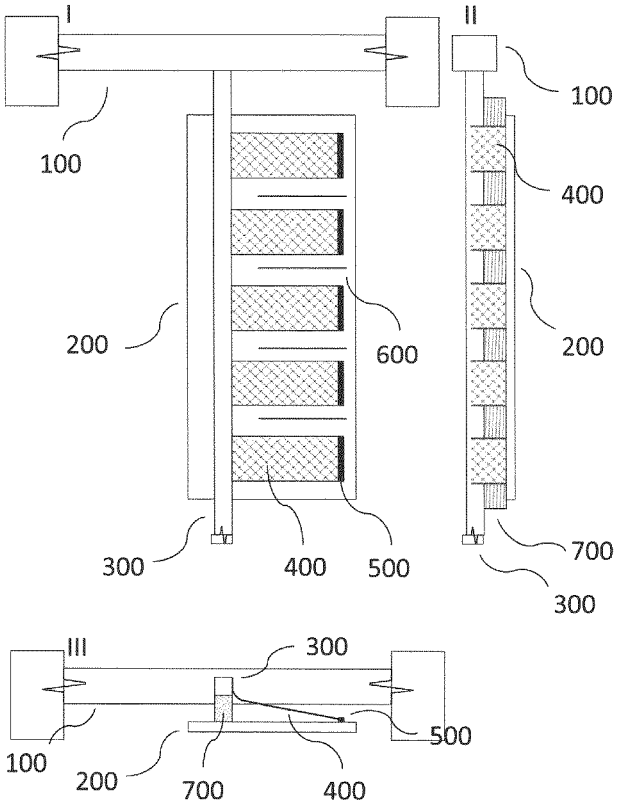

FIG. 2 provides a view from the rear (I), side (II) and bottom (III) of one embodiment of the anodic apparatus according to the invention. In this embodiment the resistors (400) are expanded meshes of titanium welded to the anodic panel (200) in correspondence of the electrical connection regions (500). On the panel there is a zone of electrical discontinuity (600) between each neighbouring pair of connection regions. These zones of discontinuity give rise to a partial fragmentation of the anodic panel along the vertical direction. It has been observed that if there is contact between a dendritic formation and an area of the panel lying between two areas of discontinuity the current may preferably flow through the resistor (or resistors) in proximity of the nearest connection region (or regions). The electrical resistance opposing the current in the event of direct contact between the electrodes will therefore be close to the resistance $R_i$ of the individual resistor. This will in turn be suitably dimensioned by a person skilled in the art in such a way as to ensure that under the operating conditions of the plant the maximum current passing through a contact spot on the panel is kept below a predetermined threshold value in order to preserve the apparatus. On the other hand, under the nominal operating conditions of the plant the electrical resistance offered by the anodic apparatus essentially corresponds to the equivalent electrical resistance $R_{eq}$ of the parallel circuit formed by the plurality of resistors, where $R_{eq} \ll R_i$. When the resistors are identical to each other and are present in a number $N_R$, $R_{eq}$ will correspond to $R_i/N_R$. By choosing a suitable number of resistors and an appropriate resistance $R_i$ it is therefore possible to obtain both a small drop in efficiency in the elemental cell while at the same time ensuring that the anodic panel is protected in the event of electric contact between the electrodes.

In the embodiment illustrated in FIG. 2, an insulating element (700) is located between the anodic panel and the current distribution structure (300). This element contributes to prevent the anodic panel and the distribution structure from coming into direct contact by accident. It also constitutes a mechanical supporting element for the panel. The anodic panel, the insulating element and the current distribution structure can be secured together by fastening means (not shown in figure).

Figure 3:
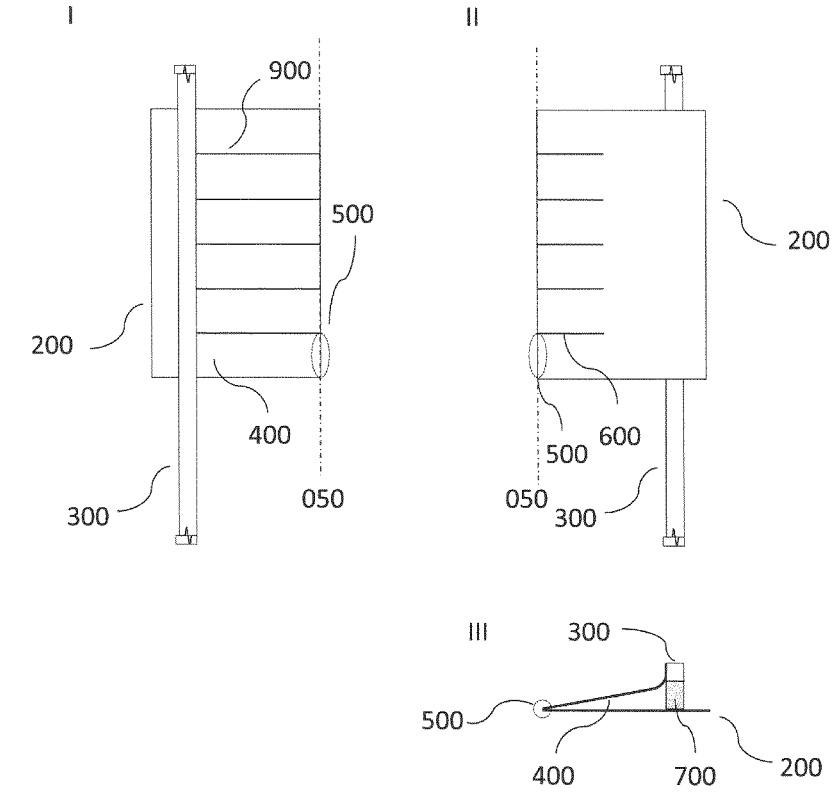

FIG. 3 shows a view from the rear (I), front (II) and bottom (III) of an embodiment of the anodic apparatus according to the invention. The anodic panel and the resistors are manufactured from a single flat element which is partly folded back on itself along a vertical direction (050). The folded edge of this flat element is provided with a plurality of horizontal cuts (900) and is in contact with the current distribution structure (300). The horizontal cuts (900) subdivide the folded part of the element into a plurality of resistors (400) in parallel. The cuts extend over the frontal plane of the anodic panel (200), providing the zones of discontinuity (600). The electrical connection regions (500) represent the imaginary separation between the frontal plane where the anodic reaction takes place (i.e. the anodic panel) and the parallel strips which constitute the resistors. The insulating element (700) may be constructed as illustrated in figure or may advantageously extend within the space between the anodic panel (200) and the plurality of resistors (400) in order to prevent any accidental electrical contact between the different elements.

Figure 4:
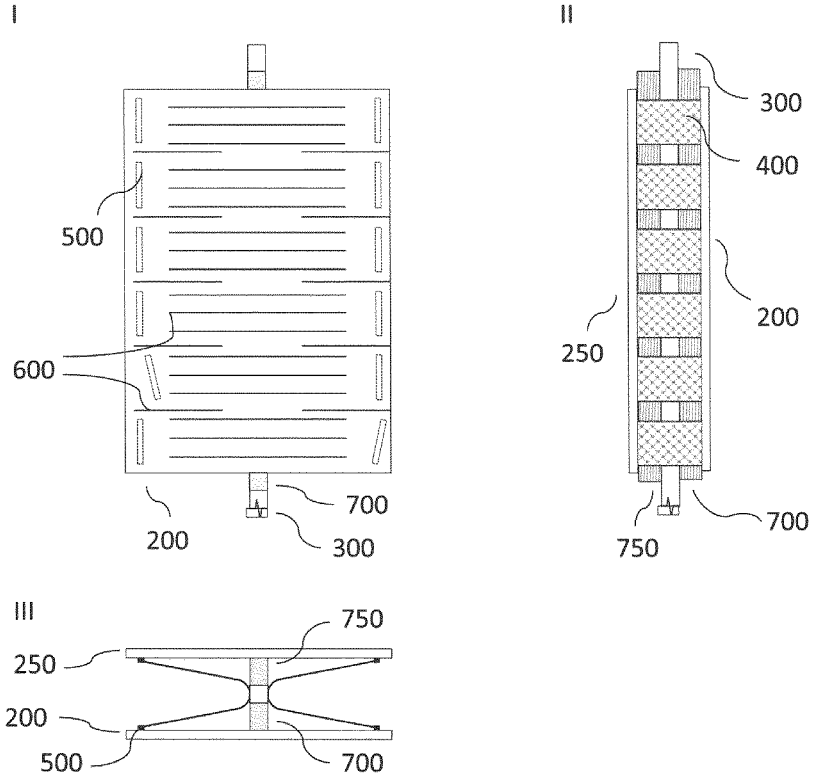

FIG. 4 provides a front (I), side (II) and bottom (III) view of an embodiment of the anodic apparatus according to the invention. This embodiment comprises two anodic panels (200) and (250) connected to the current distribution structure through a plurality of resistors (400) in parallel. Each panel is connected to the plurality of resistors through electrical connection regions (500) located along two different vertical strips. As illustrated in the figure, the connection regions may be different from each other. A plurality of zones of electrical discontinuity (600) are located between the different pairs of connection regions. Insulating element (700) and insulating element (750) are inserted between the anodic panels (200) and (250) and the current distribution structure (300) respectively. Further insulating elements (not shown in the figure) may be advantageously inserted between the resistors connected to the anodic panel (200) and the resistors connected to the anodic panel (250).

Figure 5:
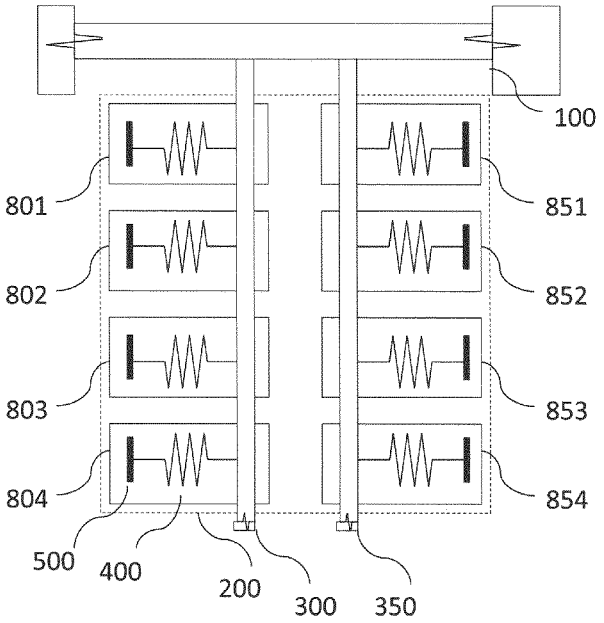

FIG. 5 illustrates a rear view of an embodiment of the invention characterised by two current distribution structures (300) and (350), an anodic panel (200) and an anodic hanger bar (100).

Figure 6:
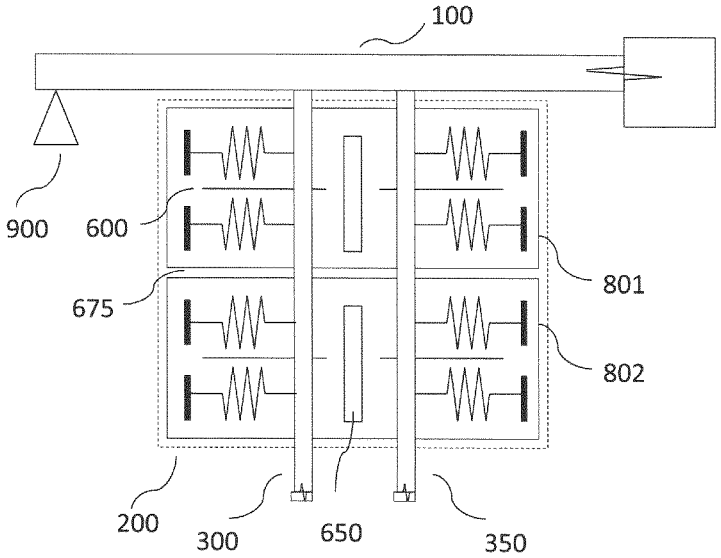

The anodic panel (200) comprises a plurality of subpanels (801, 802, 803, 804, 851, 852, 853, 854) which are physically separated from each other. Each subpanel is connected to a current distribution structure through at least one resistor (400). FIG. 6 shows a rear projection of an embodiment of the apparatus according to the invention characterised by two current distribution structures (300, 350) connected to one anodic panel (200), comprising two subpanels (801, 802), through a plurality of resistors. The two current distribution structures are also connected to an anodic hanger bar (100). The latter is electrically connected to an anodic bus-bar (900) illustrated here in cross-section. The anodic panel is provided with a plurality of partial zones of electrical discontinuity, for example horizontal cuts (600) and through holes (650), and a zone of total electrical discontinuity (675).

Figure 7:
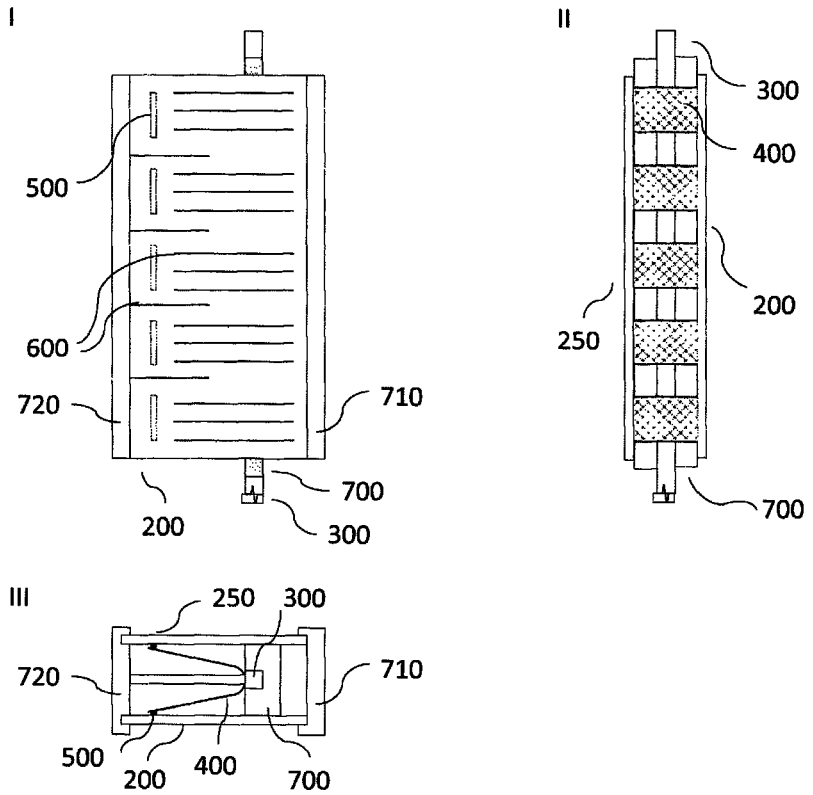

FIG. 7 provides a front (I), side (II) and bottom (III) view of an embodiment of the anodic apparatus according to the invention. In this embodiment the resistors (400) are expanded meshes of titanium welded on two anodic panels (200, 250) in correspondence of the connection regions (500). On each panel there is a zone of electrical discontinuity (600) between each pair of neighbouring contact regions. These zones of electrical discontinuity give rise to a partial fragmentation of the anodic panel along the vertical direction. An insulating element (700) is located between the anodic panels and the current distribution structure (300). Two further insulating elements (710, 720) ensure that the panels (200, 250) are kept mutually parallel and flat (sometimes the planarity of the panel is compromised by the cuts on its outer edges and or the flexibility of its structure, especially in case valve metal meshes are used), providing further mechanical support to the anodic apparatus. The elements (710, 720) are omitted from the side view (II) to allow the arrangement of the other parts of the apparatus to be seen in the figure. The insulating elements, the current distribution structure and the anodic panels are attached together by fastening means, not shown in figure, such as for example clamps of insulating material and/or bolts.

Figure 8:
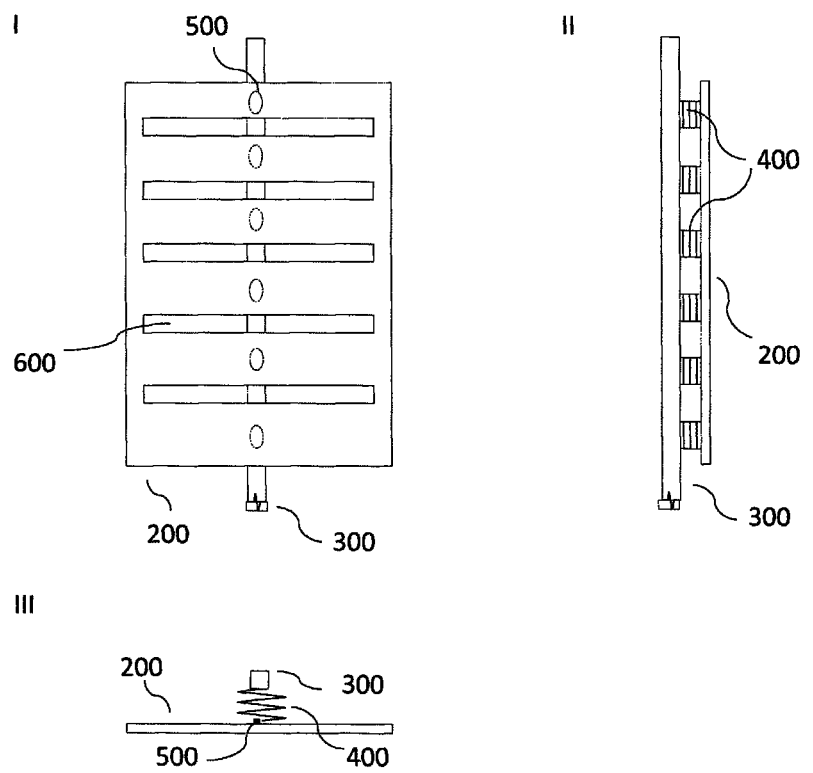

FIG. 8 provides a front (I), side (II) and bottom (III) view of an embodiment of the anodic apparatus according to the invention. In this embodiment the resistors (400) are strips of titanium folded in an accordion-like fashion and welded to the anodic panel (200) in correspondence of the electrical connection regions (500). A through hole (600) is placed between each neighbouring pair of connection regions (500).

Figure 9:
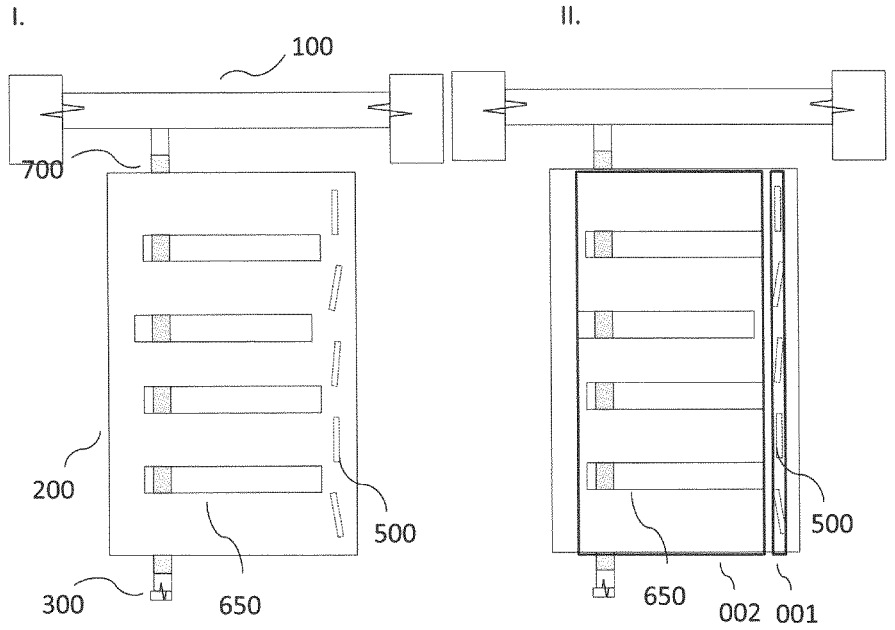

FIG. 9 (I) provides a front view of an embodiment of the anodic apparatus according to the invention. The anodic panel (200) is connected to a current distribution structure (300) through a plurality of resistors (not shown in figure) connected to the panel through connection regions (500). The panel is also provided with a plurality of holes (650) and an insulating element (700).

FIG. 9 (II) provides a front view of the anodic apparatus of FIG. 9 (I), where a first vertical strip (001) and a second vertical strip (002) are emphasized. The electrical connection regions (500) are arranged along said first vertical strip, and the holes (650) are arranged along said second vertical strip. The holes alternate with the neighbouring electrical connection regions in the vertical direction, while maintaining a minimum distance >0 from said regions.

Figure 10:
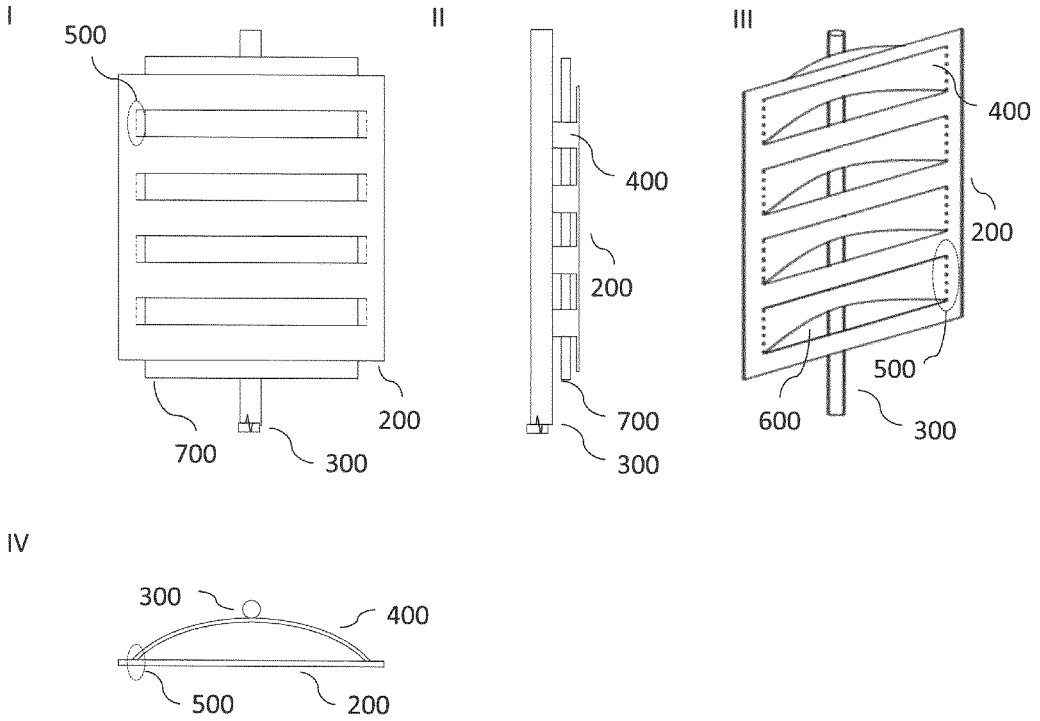

FIG. 10 illustrates a frontal (I), lateral (II), and inclined (III) projection and a projection from below (IV) of one embodiment of the anodic apparatus according to the invention. The anodic panel (200) and the resistors (400) are manufactured from a single flat element. A plurality of horizontal cuts on the anodic panel produces a plurality of strips. One every two strips is pushed back in a direction at right angles to the anodic panel, creating a resistor (400). The resistors are electrically connected in parallel with the current distribution structure (300). The horizontal cuts also identify a plurality of zones of electrical discontinuity (600) corresponding to void left by the resistor strips (400). An insulating element (700) is inserted between the resistors (400) and the anodic panel (200). This ensures that the surface of the resistors is not involved in the gas evolution reaction of the anodic apparatus when the latter is operational within an electrolyser for electrowinning or electrorefining. For clarity, the insulating element (700) is omitted from views III and IV. The electrical connection regions (500) illustrate the area of imaginary separation between the electrochemically active surface of the anodic panel and the parallel strips constituting the resistors.

Figure 11:
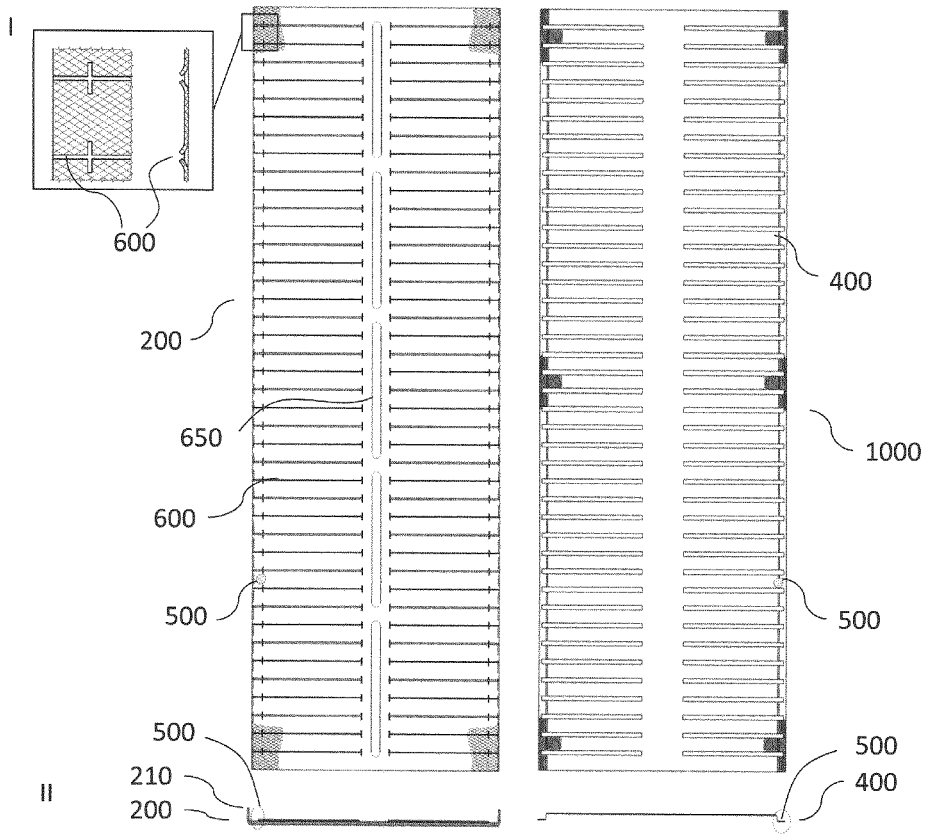

FIG. 11 provides a front view (I) and a view from below (II) of two elements of the anodic apparatus according to the invention: the anodic panel (200) and the plurality of resistors (400). In this embodiment the anodic panel and the resistors are both made of expanded meshes of titanium. As illustrated in the boxed enlargement of panel (I), the anodic panel (200) has a slightly curved profile in correspondence of the cuts (600) (and cuts (650), profile not shown). Preferably, during the assembly of the anodic apparatus, the anodic panel is mounted in such a way that the curved edges of the zones of electrical discontinuity (600, 650) are re-entrant in the direction of the resistors (and the electrical current distribution structure). The inventors have observed that said curvature may favour the detachment of dendritic formations, when these impinge on, and become attached to, the perimeters of the cuts or holes present on the surface of the anodic panel. The anodic panel exhibits folded edges (210), which may improve its mechanical robustness, preventing the panel from twisting and bending, in particular when the latter is made of expanded meshes or flexible sheets of valve metal. In the present embodiment the plurality of resistors (400) is constructed within a resistive panel (1000) of a single expanded titanium mesh provided with holes. On the basis of their number and size, the holes identify a plurality of parallel strips exhibiting a predetermined electrical resistance. The resistive panel may be shaped and bent as illustrated in the cross section of view II. The resistive panel is connected to the anodic panel by welding the two together along a plurality of regions located in correspondence the of the areas of contact of the two panels when the resistive panel (1000) is located within the anodic panel (200) (i.e. enclosed within its folded edges (210)). The electrical connection regions (500) (only one of which is singled out for clarity) are in this case located in correspondence of the welding points of the resistors, or of the continuous edge of the resistive panel, on the anodic panel. An insulating element may be placed between the resistive panel (1000) and the anodic panel (200) to prevent accidental contacts between the two. Said insulating element may also prevent dendritic formations from growing through the holes (600) and (650) and impinge directly onto the resistive panel (1000). The latter may be connected to a current distribution structure along the central vertical rib. The vertical lateral edges of the anodic panel and of the resistive panel may be continuous. In alternative, the cuts (600) on the anodic panel or the cuts making up the strips of the resistive panel may reach and break up the edges of the respective panels.

An anodic apparatus having two or more current distribution structures may advantageously mount the system described in FIG. 11 on each distribution structure.

Figure 12:
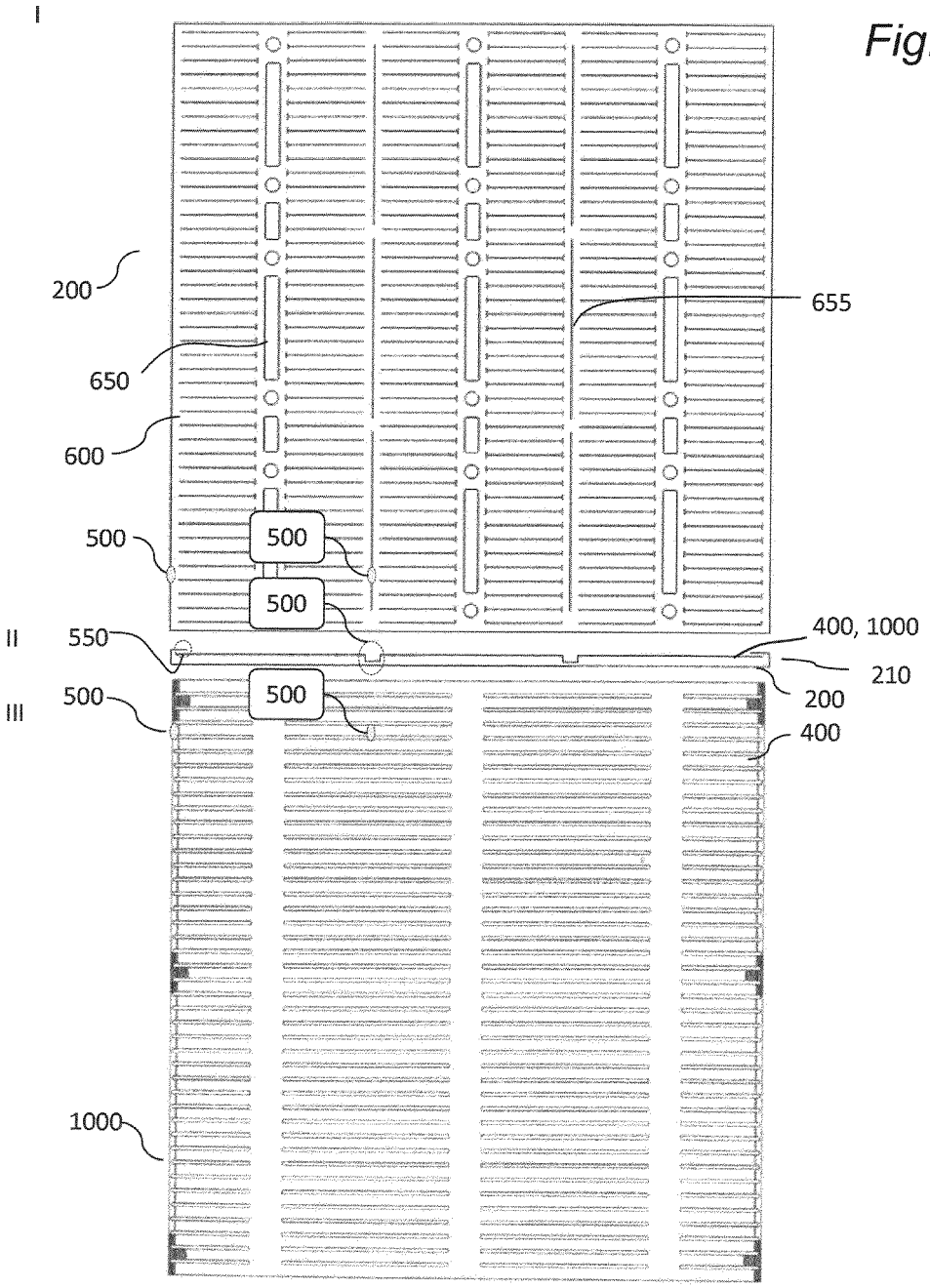

FIG. 12 shows a view from the front (I) and bottom (II) of an embodiment of the anodic panel (200) according to the invention. The figure also shows a view from the front (III) and bottom (II) of a corresponding plurality of resistors (400) incorporated in a resistive panel (1000). The anodic panel (200) is provided with a plurality of zones of electrical discontinuity and is provided with two folds (210) along the vertical edge, which improve its mechanical stability. The resistors (400) incorporated in the resistive panel (1000) are made and dimensioned as a number of holes of suitable size made therein. Resistive panel (1000) is connected to anodic panel (200) through a plurality of welds, located for example in correspondence of region (550). In this case region (550) is located on a portion of the folded edge of the anodic panel (200) and not directly on the anodic surface (where the gas evolution reaction takes place). The electrical connection region (500) corresponding to welding region (550) is located on the edge of the panel at the same height as the resistor, and represents (as hereinbefore defined) the portion of the conductive element located on the anodic panel corresponding to the shortest electrical path between the individual resistor and the panel. Some electrical connection regions (500) are illustrated in figure as examples.

Figure 13:
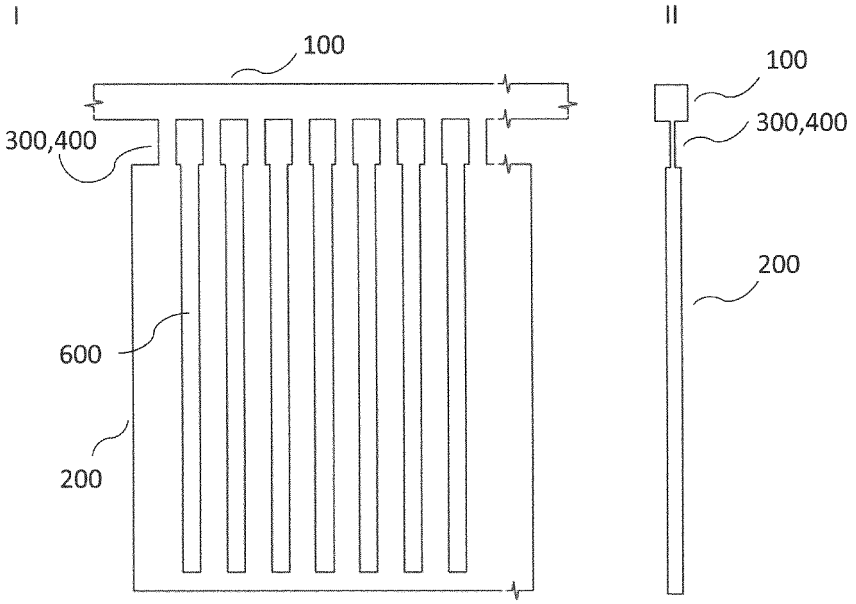

FIG. 13 illustrates a frontal (I) and lateral (II) projection of one embodiment of the invention. The anodic panel (200), the current distribution structure (300) and the resistors (400) are incorporated into a single continuous structure which can in turn be integral with (or connected to) the anode hanger bar (100). The current distribution structure (300) coincides with the plurality of resistors (400): this comprises a plurality of bars, preferably 8 or more, capable of conducting current from the anode support bar (100) to the anodic panel (200), offering an electrical resistance of $5 \cdot 10^{-5} \Omega$ or more. The anodic panel is equipped with zones of electrical discontinuity (600).

The following examples are included to demonstrate particular embodiments of the invention, whose implementation has been abundantly verified within the range of values claimed. Those skilled in the art should appreciate that the compositions and techniques described in the following examples represent compositions and techniques which the inventors have found to operate well in the implementation of the invention; however, in the light of this description those skilled in the art should be aware that many changes may be made to the specific embodiments disclosed while still achieving a similar or analogous result without going beyond the scope of the invention.

Example 1

A set of laboratory tests was carried out in a single electrodeposition cell having an overall transverse cross-section of 170 mm×170 mm and a height of 1500 mm, containing two cathodes and an anodic apparatus located between them. A sheet of AISI 316 stainless steel of thickness 3 mm, width 150 mm and height 1100 mm (of which 1000 were immersed in the electrolytic solution) was used for the cathodes. The anodic apparatus comprised two panels of titanium arranged in a configuration similar to that simplified in the sketch of FIG. 7. Each panel vertically faced one of the two cathodes at a distance of 40 mm between outer surfaces. The two anodic panels were positioned on opposite sides of the same current distribution structure. Each anodic panel was a louver structure 1 mm thick, 150 mm wide and 1000 mm tall, activated with a mixed coating of iridium and tantalum oxides.

Each panel was connected to the electrical current distribution structure through a connection of 30 resistors placed in parallel, each resistor consisting of an expanded titanium mesh of 2 cm×10 cm in size and characterised by an electrical resistance of 30 mΩ each.

The 30 resistors were connected to each panel through 30 electrical connection regions (i.e. welds) located along a vertical strip. The resistors were also connected to the current distribution structure, which was in turn supported by a conductive hanger bar. Horizontal cuts approximately 10 cm long were created on one vertical side of each panel. Each cut lay between two neighbouring electrical connection regions.

An insulating element was inserted between each panel and the current distribution structure. Two further insulating elements clamped the outer vertical edges of the two panels, maintaining them planar and parallel to each other.

The cell operated using an electrolyte containing 50 g/l of copper as $CuSO_4$ and 200 g/l of $H_2SO_4$ and was fed with current of 136.5 A at a constant voltage of 1800 V corresponding to an expected current density of approximately 455 $A/m^2$. Oxygen was released at the anodic panel and copper was deposited on the cathode.

A dendrite was artificially produced by inserting a screw, as a nucleation centre, in the stainless-steel sheet of one of the two cathodes and perpendicularly to the anodic panel. The tip of the screw was positioned 5 mm from the anodic panel. After 36 hours of operation, growth of copper was observed on the dendrite and this resulted in contact between the dendrite and panel.

The cell was kept in operation for the next 40 hours following contact. When operations ended the cathodes were removed from the cell. The cathode affected by the dendritic formation was removed from the cell without difficulty. The anodic panel opposite to it had a slight surface deterioration, corresponding to the area of contact with the dendrite, of approximately 1 cm×0.5 cm. No holes, deformations or any other significant damages which could affect the functioning of the panel were observed.

When the cell was subsequently put in operation it was observed that copper deposition on the cathodes opposite the anodic panel with the slight surface deterioration was uniform.

Comparison Example 1

The test in example 1 was repeated under the same conditions, except that the anodic apparatus was replaced by an apparatus comprising two panels of titanium 1 mm thick, 150 mm wide and 1000 mm tall, activated with a mixed coating of iridium and tantalum oxide. Each panel was a louver structure directly electrically connected to the same titanium-coated copper bar and supported by a conductive hanger bar. A dendrite was artificially produced by inserting a screw as a centre for nucleation in the stainless-steel sheet of one of the two cathodes, perpendicularly to the anodic panel. The tip of the screw was positioned 5 mm from the anodic panel. After 8 hours' operation growth of copper which led to contact between the dendrite and panel was found on the dendrite.

The cell was kept in operation for the next 20 hours following contact. When operations ended the cathodes were removed from the cell. The cathode affected by the dendritic formation was removed from the opposite anodic panel with difficulty. The latter had a circular hole of diameter approximately 2.5 cm corresponding to the area of contact with the dendrite.

When the cell was subsequently in operation it was observed that copper deposition on the cathode opposite the hole in the anodic panel was non-uniform.

The above description is not intended to limit the invention, which may be used in accordance with various embodiments without thereby going beyond its scope, which is defined by the appended claims.

In the description and the claims in this application the words "comprise" and its variations such as "comprising" and "comprises" do not rule out the presence of other additional elements, components or stages.

The discussion of documents, deeds, materials, apparatus, articles and the like is included in the text solely for the purpose of providing context for this invention; it should not however be understood that this material or part thereof constitutes general knowledge in the field relating to the invention prior to the priority date of each of the claims appended to this application.

The invention claimed is:

1. Anodic apparatus for electrorefinement or electrolytic extraction of non-ferrous metals comprising at least one anodic panel, which is used as an anode and presents at least one surface capable of evolving oxygen or chlorine, and at least one electrical current distribution structure, characterized by the fact that said at least one anodic panel is equipped with at least one zone of partial or total electrical discontinuity, wherein the zone of partial electrical discontinuity is an electrically insulating region measuring at least 1 cm along at least one dimension located within the anodic panel and optionally includes edges, and wherein the zone of total electrical discontinuity is an electrically insulating region measuring at least 1 cm along at least one dimension extending along a whole dimension of the panel, thus subdividing the panel into several subpanels, and said at least one electrical current distribution structure is electrically connected to said at least one anodic panel by a plurality of resistors set in parallel with one another, each resistor of said plurality of resistors having a resistance, measured at 40° C., equal to or greater than $5 \cdot 10^{-5}\Omega$, wherein said at least one anodic panel is equipped with at least a number N1 of electrical connection regions connected with said plurality of resistors and at least a number N2 of zones of electrical discontinuity, said N1 connection regions being arranged along a first vertical strip, said N2 zones of electrical discontinuity being arranged along a second vertical strip; N1 being a number of between 5 and 100 and N2 being greater than 0.5·N1.

2. The apparatus of claim 1, wherein said at least one anodic panel is made up of a substrate made of valve metal or its alloys and at least one catalytic coating.

3. The apparatus of claim 1, wherein said at least one anodic panel is chosen from mesh, perforated plates or louver structures.

4. The apparatus according to claim 1, wherein each anodic panel is electrically connected to at least one electrical current distribution structure by a number of between 15 and 600 resistors set in parallel.

5. The apparatus of claim 1, wherein said plurality of resistors is connected to said at least one anodic panel through a plurality of electrical connection regions situated on the panel and said at least one zone of electrical discontinuity is situated between two neighbouring electrical connection regions.

6. The apparatus of claim 1, wherein said plurality of resistors is connected to said at least one anodic panel through a plurality of electrical connection regions, said anodic panel having a plurality of zones of electrical discontinuity, and for every two neighbouring zones of electrical discontinuity set at a height h1 and h2 with respect to the base of said at least one anodic panel, with $h1<h2$, there is at least one connection region situated at a height h3, with $h1 \leq h3 \leq h2$.

7. The apparatus of claim 1, wherein said at least one anodic panel is equipped with at least a number N3 of further electrical connection regions connected with said plurality of resistors, said N3 connection regions being arranged along a third vertical strip, and N3 being a number between 5 and 100.

8. The apparatus of claim 7, wherein at least one anodic panel is equipped with at least a number N4 of further zones of electrical discontinuity, with N4 being greater than $0.5 \cdot N3$, said N4 zones of electrical discontinuity being arranged along a fourth vertical strip.

9. The apparatus according to claim 1, wherein at least one zone of electrical discontinuity is a cut, hole or an insert of electrical insulating material.

10. The apparatus according to claim 1, wherein said at least one zone of electrical discontinuity measures at least 5 cm in length along at least one dimension.

11. The apparatus according to claim 8, wherein said anodic panel comprises at least two titanium anodic subpanels separated from one another, said at least two subpanels being chosen from louver, sheets and expanded mesh structures, and at least two electrical current distribution structures, each electrical current distribution structure being connected to a subpanel by a plurality of resistors set in parallel with one another, each subpanel comprising 5-100 connection regions arranged along a first vertical strip, each connection region being alternated with a horizontal cut having a length of at least 5 cm and each cut having at least one point set at a distance of 0-10 cm from said first vertical strip.

12. The apparatus according to claim 1, wherein said anodic panel is equipped with at least 20 zones of electrical discontinuity and at least 20 connection regions capable of connecting said at least one anodic panel with at least 20 resistors set in parallel with one another, each zone of electrical discontinuity being set at a distance of less than 15 cm from at least one of said connection regions.

13. The apparatus according to claim 1, wherein each resistor of said at least one plurality of resistors has an electrical resistance of between $5 \cdot 10^{-4}$ and $1\Omega$.

14. The apparatus according to claim 13, wherein each said resistor has an electrical resistance of between 5 and 100 $m\Omega$.

15. The apparatus according to claim 1, wherein said plurality of resistors set in parallel has an equivalent electrical resistance of between $10^{-5}$ and $10^{-3}\Omega$.

16. The apparatus according to claim 1, wherein each resistor of said plurality of resistors is chosen from the group consisting of plates, strips, meshes, cables, fabrics and pads.

17. The apparatus according to claim 1, wherein said plurality of resistors is a sheet, an expanded mesh or a perforated plate of valve metal with zones of electrical discontinuity.

18. The apparatus according to claim 1, wherein said at least one anodic panel and said plurality of resistors are a single piece of a bent sheet, expanded mesh or perforated plate of valve metal.

19. The apparatus according to claim 1, wherein the electrical current distribution structure comprises a sheet or panel made of lead or lead alloys.

20. An electrolyser for electrolytic extraction of non-ferrous metals comprising at least one anodic apparatus as described in claim 1.

* * * * *